US006733084B2

(12) United States Patent
Butler

(10) Patent No.: US 6,733,084 B2
(45) Date of Patent: May 11, 2004

(54) BOAT COMFORT SEAT ASSEMBLY

(75) Inventor: David L. Butler, Ravenna, OH (US)

(73) Assignee: Moeller Marine Products, Twinsburg, OH (US)

( * ) Notice: Subject to any disclaimer, the term of this patent is extended or adjusted under 35 U.S.C. 154(b) by 0 days.

(21) Appl. No.: 10/358,901

(22) Filed: Feb. 5, 2003

(65) Prior Publication Data

US 2003/0155798 A1 Aug. 21, 2003

Related U.S. Application Data

(60) Provisional application No. 60/354,873, filed on Feb. 6, 2002.

(51) Int. Cl.[7] ..... A47C 7/02

(52) U.S. Cl. ..... 297/452.56; 297/440.22

(58) Field of Search ..... 297/452.56, 452.55, 297/452.57, 440.1, 440.22

(56) References Cited

U.S. PATENT DOCUMENTS

| | | | | | |
|---|---|---|---|---|---|
| 614,222 | A | | 11/1898 | Duwe | |
| 2,005,972 | A | | 6/1935 | Gallop | 5/327 |
| 2,150,287 | A | | 3/1939 | Minor | 18/53 |
| 3,107,944 | A | * | 10/1963 | Baermann | 297/452.56 |
| 3,371,957 | A | * | 3/1968 | Cook | 297/225 |
| 3,382,511 | A | | 5/1968 | Brooks | 5/355 |
| 3,549,201 | A | | 12/1970 | Wolfe | 297/284 |
| 3,635,524 | A | | 1/1972 | Faust | 297/284 |
| 3,638,896 | A | | 2/1972 | Lindstrom | 248/399 |
| 3,833,952 | A | | 9/1974 | Rosenberg | 5/353 |
| 4,522,447 | A | | 6/1985 | Snyder et al. | 297/452 |
| 4,722,706 | A | | 2/1988 | Young | 440/7 |
| 4,727,821 | A | | 3/1988 | Masters | 114/347 |
| 4,883,320 | A | | 11/1989 | Izumida et al. | 297/452 |
| 4,901,968 | A | | 2/1990 | Ellis et al. | 248/407 |
| 4,910,817 | A | | 3/1990 | Kita | 5/246 |
| 5,286,089 | A | | 2/1994 | Goldman | 297/452.26 |
| 5,439,271 | A | * | 8/1995 | Ryan | 297/452.56 |
| 5,441,331 | A | * | 8/1995 | Vento | 297/452.33 |
| 5,575,533 | A | | 11/1996 | Glance | 297/452.2 |
| 5,613,256 | A | | 3/1997 | Hanson | 5/653 |
| 5,692,450 | A | | 12/1997 | Alter et al. | 114/61 |
| 5,735,578 | A | * | 4/1998 | Penley | 297/440.11 |
| 5,836,655 | A | * | 11/1998 | Laufer | 297/452.63 |
| 5,988,748 | A | | 11/1999 | Morrison et al. | 297/328 |
| 6,010,195 | A | | 1/2000 | Masters et al. | 297/452.55 |
| 6,079,784 | A | | 6/2000 | Peachey | 297/284.5 |
| 6,109,200 | A | | 8/2000 | Rieger | 114/363 |
| 6,113,186 | A | * | 9/2000 | Holmes et al. | 297/248 |
| 6,135,550 | A | | 10/2000 | Tucho | 297/199 |
| 6,231,125 | B1 | * | 5/2001 | Maeda et al. | 297/452.56 |
| 6,234,578 | B1 | | 5/2001 | Barton et al. | 297/452.41 |
| 6,334,227 | B1 | | 1/2002 | Larger | 5/653 |

* cited by examiner

*Primary Examiner*—Peter R. Brown
(74) *Attorney, Agent, or Firm*—Howard & Howard

(57) ABSTRACT

A seat assembly includes a seat bottom having first and second portions and a central support portion, disposed between the first and second portions, and a seat back having a top portion and a bottom portion, wherein the seat back extends upwardly from and supported by the seat bottom. To support a user and to provide resiliency to the seat assembly, the invention includes an elastic mat having a first end mounted to the first portion and a second end mounted to one of the second portion and the bottom portion of the seat back such that the elastic mat is suspended over the central support portion of the seat assembly. The seat bottom includes at least two rails adjacent and spaced from one another for retaining a portion of a seat track of a base that is further attached to a post, extending from a floor of the boat.

21 Claims, 4 Drawing Sheets

BOAT COMFORT SEAT ASSEMBLY

This application claims the benefit of Provisional application Ser. No. 60/354,873, filed Feb. 6, 2002.

BACKGROUND OF THE INVENTION

1. Field of the Invention

The subject invention relates to a seat assembly, and more particularly to the seat assembly having a mat of a flexible material installed within the seat assembly to provide a soft support, resiliency, and cushioning to a user.

2. Description of the Prior Art

Numerous seat assemblies with means for providing resiliency and cushioning to a user and to preclude excessive sagging under the weight of the user are known in the prior art and are widely used today in various industries. Generally, when travelling at a high speed, a marine vehicle such as a boat is usually subject to heavy and violent blows and shocks as a result of waves running against the boat. Such blows cause discomfort and may make a marine voyage or fishing trip very unpleasant.

One conventional system for providing resiliency and cushioning to the user and to preclude excessive sagging under the weight of the user is disclosed in U.S. Pat. No. 3,833,952 to Rosenberg (the Rosenberg patent). The Rosenberg patent discloses an energy absorption system for a seat assembly having a plurality of nonlinear support elements between a metal seat pan and the buttocks of a user. Each of these support elements is equipped with a helical spring that cushions the user. As appreciated by those skilled in the art of marine vehicles, the use of springs of any kind to provide resiliency to the seat in the marine industry is not recommended due to the corrosive elements, water, salt, etc. encountered in typical marine applications. Several prior art patents, more particularly, U.S. Pat. No. 5,441,331 to Vento (the Vento patent), U.S. Pat. No. 6,010,195 to Masters et al. (the Masters patent), and U.S. Pat. No. 6,234,578 to Barton et al. (the Barton patent) tried to substitute the use of the springs by new inventive approaches discussed below.

The Vento patent shows a suspension system installed in a seat assembly used in a motor vehicle. The suspension system comprises an elastomeric fabric capable of providing sufficient strength to support the user. The elastomeric fabric forming suspension system is affixed to front and rear rods by any conventional means. The front and rear rods are attached to a seat assembly frame by attachments, wherein the attachments are installed within the seat frame first to secure the suspension system therewithin.

The Masters patent shows a seat assembly that includes a seat bottom trim supported on a pan defining a aperture portion. The seat frame assembly includes a mat disposed in the aperture of the pan for cushioning support of an occupant. The mat comprises a flexible woven material suspended across the aperture portion by rings and provides a soft support for the occupant.

The Barton patent shows a seat assembly including a seat bottom comprising a frame with side walls. The frame includes a central cutout region surrounded by a peripheral edge and a support mat that extends across the central cutout region. The mat is formed of a rubber suspension material or webbing to provide a balance between support and resiliency. The seating assembly includes a plurality of tabs to provide adjacent a peripheral edge of the central cutout to provide attachment locations for the mat that further includes a plurality of openings adapted to receive the tabs.

One of the areas of continuous development and research is the area of a more advanced design of a seat assembly for a boat. The opportunity remains for a new design of the seat assembly, where, unlike typical seats, a new seat assembly is easy to manufacture, simple to assembly, cost effective and does not employ the use of springs to provide resiliency to a seat portion of the seat assembly, specially when used in the marine industry, due to the corrosive elements, water, salt, etc. found in typical marine applications.

BRIEF SUMMARY OF INVENTION

A seat assembly of the present invention includes a seat bottom having a first portion and a second portion with a central support portion disposed between the first and second portions and a seat back having a top portion and a bottom portion, wherein the seat back extends upwardly from and supported by the seat bottom. The seat assembly includes a central support portion that extends from the seat back and adjacent the seat bottom. To support a user and to provide resiliency to the seat assembly, the invention includes an elastic mat having a first end mounted to the first portion and a second end mounted to one of the second portion and the bottom portion of the seat back such that the elastic mat is suspended over the central support portion of the seat assembly.

The seat assembly includes a first mounting member connected to the first end of the elastic mat and a second mounting member connected to the second end of the elastic mat. As appreciated by those skilled in the art, the seat assembly may include several different methods of securing the elastic mat with the first and second mounting members.

The seat assembly disclosed in the present invention includes a first socket and a second socket integrally disposed within the seat bottom designed to secure the first and second mounting members and the elastic mat entrained therebetween. The first socket is integrally disposed within the first portion of said seat bottom for receiving the first mounting member to facilitate the mounting of the first end of the mat to the first portion. The second socket is integrally disposed within one of the second portion of the seat bottom and the bottom portion of the seat back for receiving the second mounting member to facilitate the mounting of the second end of said mat to one of the second portion and bottom portion, respectively. The invention subject matter provides a support the user and a resiliency to the seat assembly.

One of the advantages of the present invention provides for a cushioning and support system positioned within the seat adapted to provide vertical downward movement and cushioning to a user. Still another advantage of the present invention eliminated the use on metal components such as springs due to the corrosive elements, water, salt, etc. found in typical marine applications.

Accordingly, the seat assembly shown in the present invention is new, easy to install and manufacture, and provides for an effective way to increase resiliency to the seat used in the marine industry.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
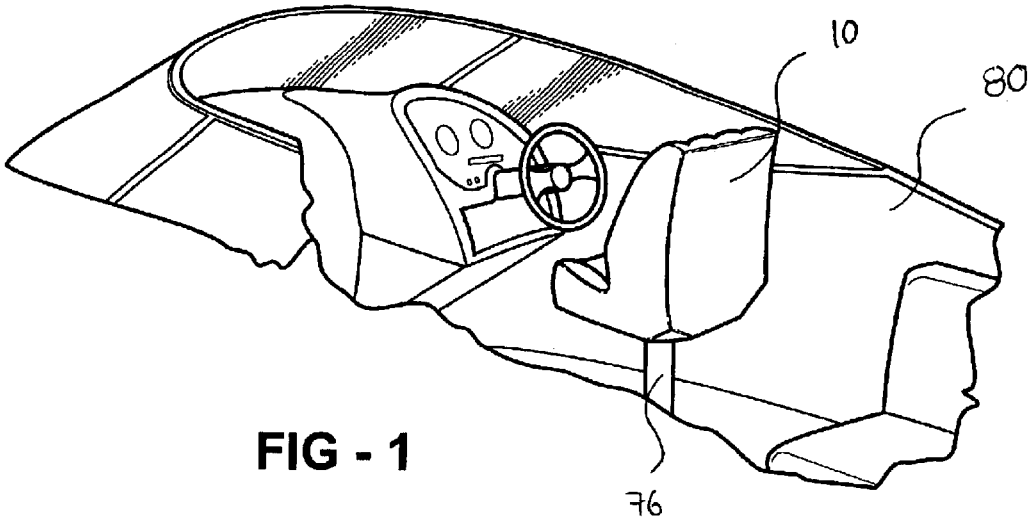
FIG. 1 is a perspective view of a seat assembly installed on a boat.

Referring to the FIGS. 1 through 8, wherein like numerals indicate like or corresponding parts throughout the several views, a seat assembly for a boat, is generally shown at 10. A seat assembly 10 of the present invention comprises a seat bottom 12 that has a first portion, generally indicated at 14, and a second portion, generally indicated at 16. The seat assembly 10 includes a seat back 18 having a top portion 20 and a bottom portion 22 with the seat back 18 extending upwardly from and supported by the seat bottom 12. The seat assembly 10 includes a central support portion 24 disposed between the first 14 and second 16 portions of the seat bottom 12.

Figure 3:
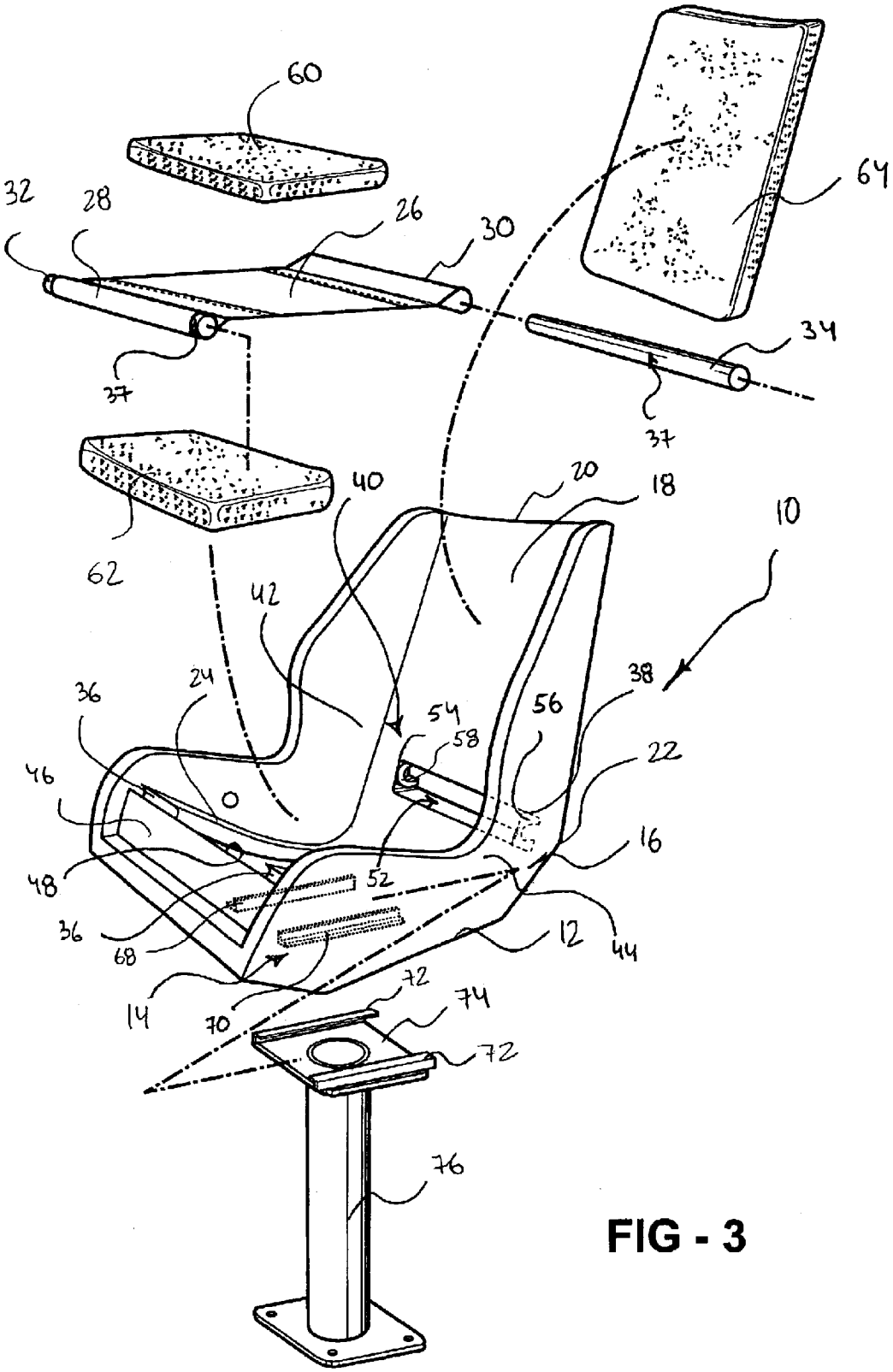
FIG. 3 is an exploded view of the seat assembly.

Referring to FIG. 3, the seat assembly 10 includes a mat 26 having a first end 28 mounted to the first portion 14 and a second end 30 mounted to one of the second portion 16 and bottom portion 12 such that the mat 26 is suspended over the central support portion 24. To secure the mat 26 within the seat assembly 10, first 32 and second 34 mounting members are provided. The first 32 and second 34 mounting members are connected to the first 28 and second 30 respective ends of the mat 26.

First 36 and second 38 sockets are integrally disposed within the first portion 14 of the seat bottom 12 and one of the second portion 16 of the seat bottom 12 and the bottom portion 22 of the seat back 18 for receiving the mounting members 32, 34, respectively. The first socket 36 is designed to receive the first mounting member 32 and to facilitate the mounting of the first end 28 of the mat 26 to the first portion 14 of the seat bottom 12. In the similar fashion, the second socket 38 is designed to facilitate the mounting of the second end 30 of the mat 26 to one of the second portion 16 and bottom portion 22, respectively.

Figure 4:
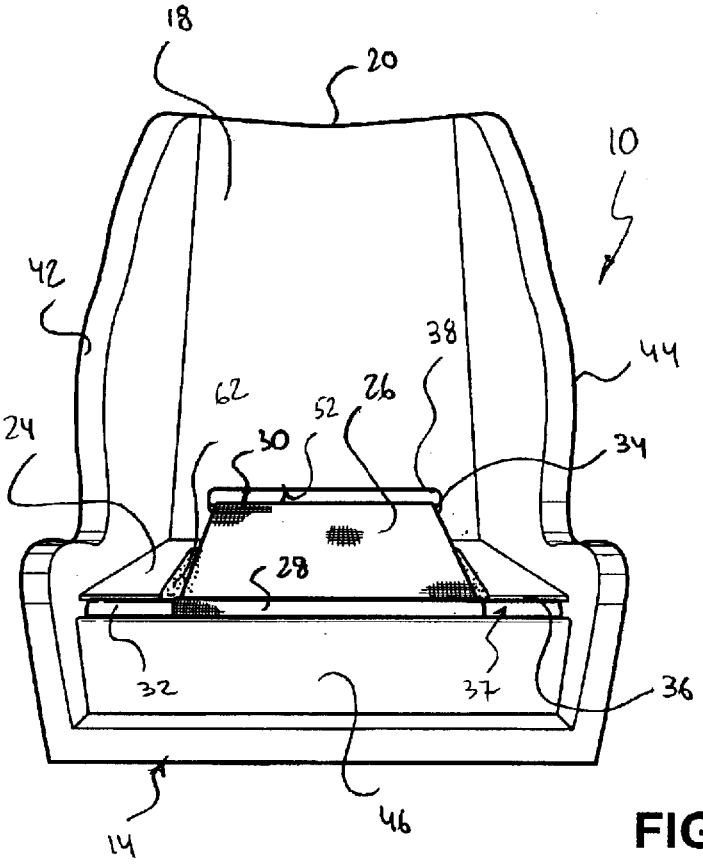
FIG. 4 is front view of the seat assembly with a mat installed therewithin.
Figure 5:
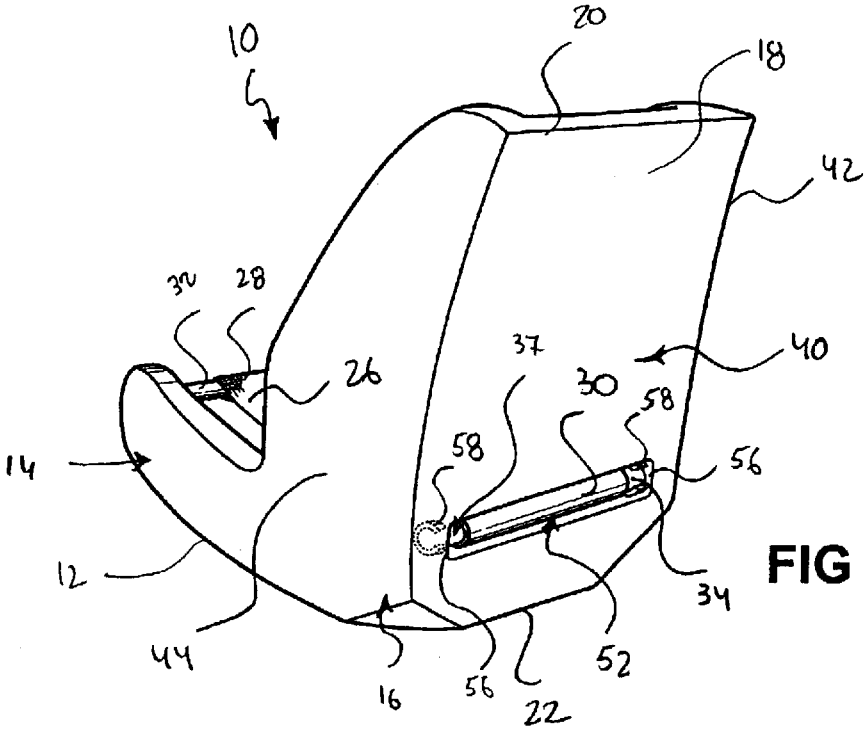
FIG. 5 is a perspective rear view of the seat assembly illustrating an aperture of a second socket defined within a seat bottom of the seat assembly.

Referring to FIGS. 3 through 5, the seat bottom 12 and the seat back 18 of the seat assembly 10 are integral and formed of a homogeneous material, which defines a continuous panel, generally indicated at 40. The continuous panel 40 extends from the first portion 14 of the seat bottom 12 to the top portion 20 of the seat back 18. The seat assembly 10 includes side walls 42, 44 adjacent and parallel to one another. The side walls 42, 44 are integral with the continuous panel 40 and extend from the first portion 14 of the seat bottom 12 to the top portion 20 of the seat back 18. The homogeneous material that forms the seat bottom 12, the seat back 18, and the side walls 42, 44 is further defined as a plastic material, such as a thermoplastic, of the type known in the art, which is preferably made by a roto-molding process, an injection-molding process or other known processes. The plastic material, which comprises the seat bottom 12, the seat back 18, and the side walls 42, 44 is a polyethylene, and preferably a high-density linear polyethylene, and the like.

Referring to FIGS. 3 and 4, the first portion 14 of the seat bottom 12 further defines a front wall 46. The front wall 46 and the central support portion 24 define the first socket 36 therebetween. The central support portion 24 includes an opening 48 that further extends inwardly to the seat bottom 12 defining a basin, generally indicated at 51. As appreciated by those skilled in the art, the front wall 46 and the central support portion 24 are formed of the homogeneous material that also forms the seat bottom 12, the seat back 18, and the side walls 42, 44.

Referring to FIGS. 3 and 4, the first socket 36 that is integrally disposed within the first portion 14 of the seat bottom 12 has a C-shaped configuration defined between the front wall 46 and the central support portion 24. The second socket 38 defines an aperture, generally indicated at 52, and side surfaces 54, 56 within the seat back 18. The aperture 52 has a generally rectangular configuration. The second socket 38 further defines a protrusion 58 that extends from each of the side surfaces 54, 56. The protrusion 58 has a C-shaped configuration. The first 36 and second 38 sockets are designed to receive and secure the first 32 and second 34 mounting members, as shown in FIG. 3.

To provide resiliency to the seat bottom 12 and a comfort to the user, the seat assembly 10 includes the mat 26. The mat includes a material that is flexible and elastic to provide up to three inches of vertical travel. Each of the ends 28, 30 of the mat 26 further defines a loop, respectively. The loops engage the first mounting member 32 and the second mounting member 34, respectively. The mounting members 32, 34 slide within the loops. Referring to FIG. 3, each of the first 32 and second 34 mounting members are defined by an elongated bar, generally indicated at 37, disposed within each of the loops. The bar 37 is made from a metal. As appreciated by those skilled in the art, the mat 26 may be installed within side sockets (not shown) further defined within the side walls 42, 44 of the present invention.

Referring specifically to FIG. 3, the seat assembly 10 includes an upper cushion 60, a lower cushion 62, and a back cushion 64 to provide comfort to the user during travel. The upper cushion 60 is disposed on the mat 26 wherein the lower cushion 62 is disposed below the mat 26 and is position in the basin 50 defined within the seat bottom 12. The back cushion 64 is abating the seat back 18. Each of the cushions 60, 62, and 64 is formed of foam, rubber, and the like.

Figure 2:
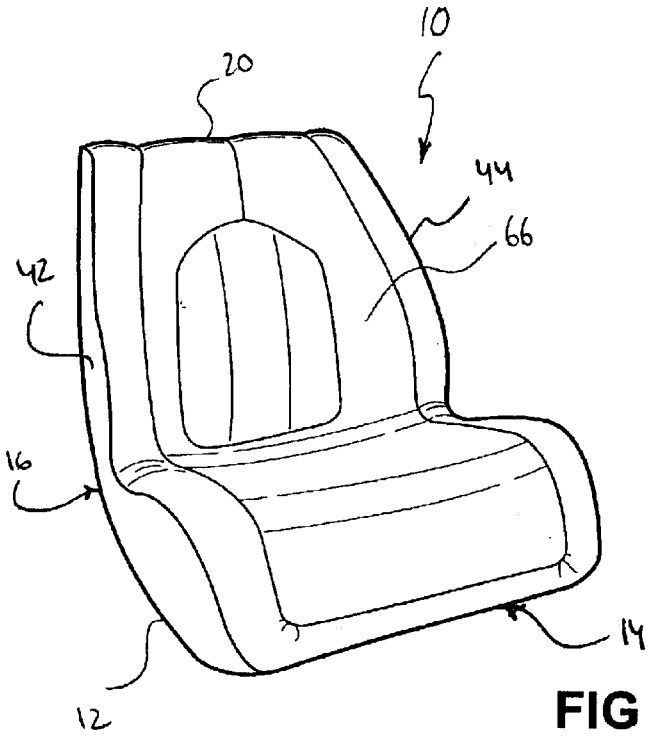
FIG. 2 is a perspective view of the seat assembly.

Referring to FIG. 2, the seat assembly 10 includes a trim cover 66 that is disposed over the seat bottom 12 and the seat back 18. The trim cover 66 encapsulates the upper 60, lower 62, and back 64 cushions. Based on the demand in the industry, the trim cover 66 may be formed of leather, polyethylene, and the like. In the alternative embodiment of the present invention, the upper cushion 60 may be encapsulated by the trim cover 66 separately to be detachable, when the user decides to change the mat 26.

Referring to FIGS. 1 and 3, the seat bottom 12 of the seat assembly 10 includes at least two rails 68, 70 adjacent and spaced from one another for retaining a portion of a seat track 72. The seat track 72 upwardly extends from a base 74 and is slidably disposed between the rails 68, 70 attached to the seat bottom 12. As appreciated by those skilled in the marine art, the base 74 is further attached to a post 76 that extends from a floor 78 of a boat 80, and secured thereto.

Figure 6:
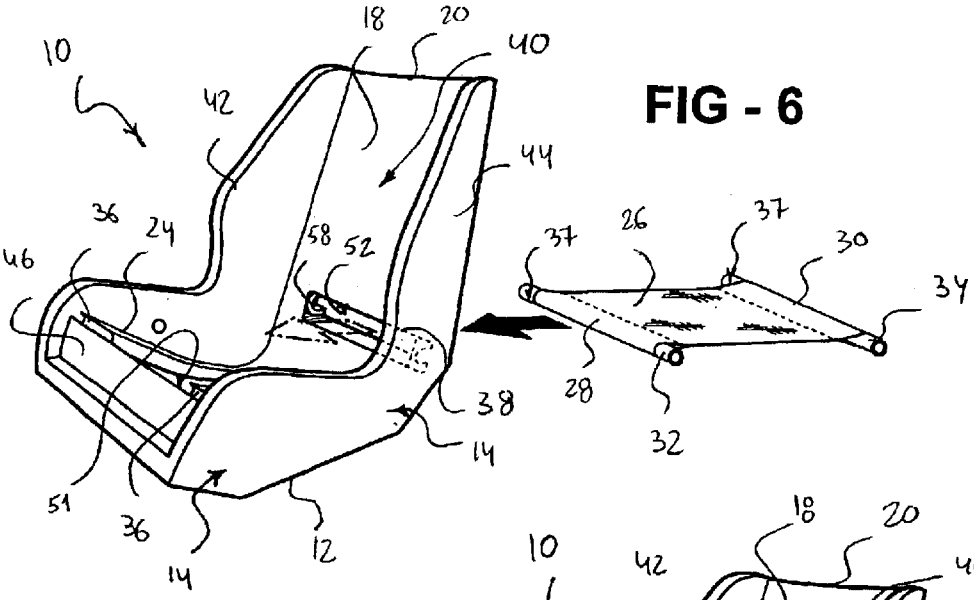
FIG. 6 is a perspective view of the seat assembly wherein the mat is positioned beyond a seat back before installation.
Figure 7:
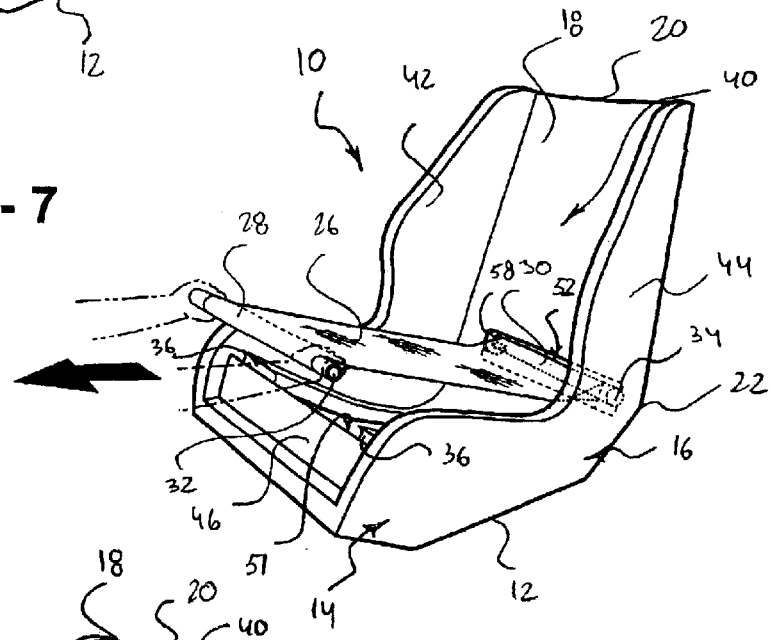
FIG. 7 is a perspective view of the seat assembly wherein the mat is positioned within a second socket and is pulled outwardly therefrom.
Figure 8:
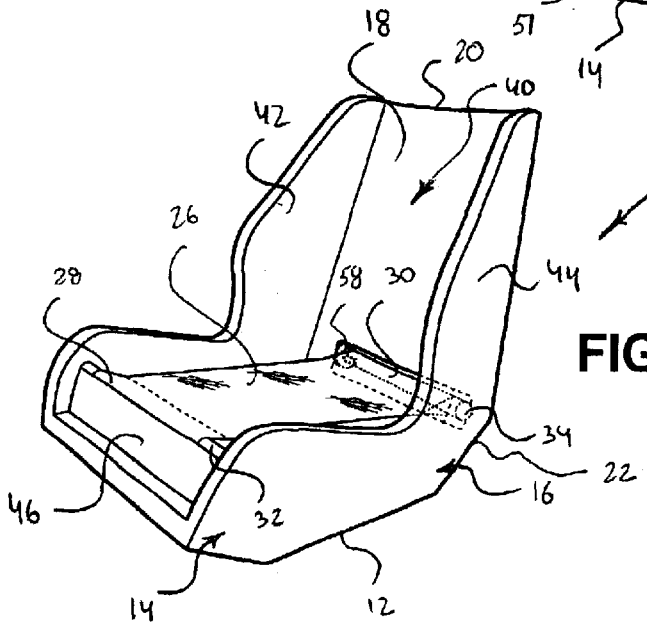
FIG. 8 is a perspective view of the seat assembly wherein the mat is installed within the seat bottom.

Referring to FIGS. 6 through 8, the mat 26 is installed within the seat bottom 12 in the following manner. The first mounting member 32, previously positioned within the loop of the first end 28 of the mat 26, slides through the aperture 52 in the seat back 18. The user then pulls the mat 26 from the back wall 18 to the front wall 46 of the seat bottom 12 until the second mounting member 34 is operably secured within the protrusion 58 of the second socket 38 to facilitate the mounting of the second end 30 of the mat 26 to one of the second portion 16 and bottom portion 22, respectively. To finish the installation of the mat 26, the user slides the first mounting member 32 into the first socket 36 to facilitate the mounting of the first end 28 of the mat 26 to the first portion 14 of the seat bottom 12.

As appreciated by those skilled in the art, the installation of the mat 26 may be performed in a reversed order. For example, the user may slide the first mounting member 32 into the first socket 36 to facilitate the mounting of the first end 28 of the mat 26 to the first portion 14 of the seat bottom 12. Then, the second mounting member 34, previously positioned within the loop of the second end 30 of the mat 26, slides through the aperture 52 in the seat back 18. To finish the installation, the user then pulls the mat 26 from the back wall 18 there beyond until the second mounting member 34 is operably secured within the protrusion 58 of the second socket 38 to facilitate the mounting of the second end 30 of the mat 26 to one of the second portion 16 and bottom portion 22, respectively.

Obviously, many modifications and variations of the present invention are possible in light of the above teachings. The invention may be practiced otherwise than as specifically described within the scope of the appended claims. These antecedent recitations should be interpreted to cover any combination in which the incentive novelty exercises its utility.

What is claimed is:

1. A seat assembly comprising:

a seat bottom having a first portion and a second portion with a central support portion disposed between said first and second portions;

a seat back having a top portion and a bottom portion with said seat back extending upwardly from and supported by said seat bottom;

said seat bottom and said seat back being integral and formed of a homogeneous material to define a continuous panel extending from said first portion of said seat bottom to said top portion of said seat back, a mat having a first end and a second end;

a first mounting member connected to said first end of said mat;

a second mounting member connected to said second end of said mat; and said first portion defining an integral first socket disposed within said first portion of said seat bottom and receiving said first mounting member to mount said first end of said mat to said first portion, and an aperture through said seat back and side surfaces defined integrally within said seat back adjacent said aperture said mat extending from said first mounting member over said seat bottom and through said aperture to said second mounting member, said second mounting member being retained by said side surfaces.

2. A seat assembly as set forth in claim 1 wherein said first portion defines a front wall, with said front wall and said central support portion defining said first socket therebetween.

3. A seat assembly as set forth in claim 2 wherein said first socket has a C-shaped configuration.

4. A seat assembly as set forth in claim 1 wherein said mounting members comprise bars with the ends thereof disposed in said first and second sockets respectively.

5. A seat assembly as set forth in claim 4 wherein said second socket further defines a protrusion extending from each of said side surfaces.

6. A seat assembly as set forth in claim 5 wherein said aperture has a generally rectangular configuration.

7. A seat assembly as set forth in claim 6 wherein said protrusion has a C-shaped configuration.

8. A seat assembly as set forth in claim 1 wherein said first end and second end of said mat each define a loop, respectively, to engage said first mounting member and said second mounting member within said loops, respectively.

9. A seat assembly as set forth in claim 8 wherein each of said first and second mounting members are defined by elongated bar disposed within each of said loops.

10. A seat assembly as set forth in claim 9 wherein said mat includes a flexible material.

11. A seat assembly as set forth in claim 10 wherein said mat has up to three inches of a vertical travel.

12. A seat assembly as set forth in claim 1 wherein said homogeneous material is further defined as a plastic material.

13. A seat assembly as set forth in claim 12 wherein said plastic material is further defined as a polyethylene.

14. A seat assembly as set forth in claim 1 including an upper cushion disposed on said mat.

15. A seat assembly as set forth in claim 14, including a lower cushion disposed below said mat.

16. A seat assembly as set forth in claim 15 wherein said central support portion includes an opening extending inwardly to said seat bottom further defining a basin to receive said lower cushion.

17. A seat assembly as set forth in claim 16 further including a back cushion abutting said seat back.

18. A seat assembly as set forth in claim 17 further including a trim cover disposed over said seat bottom and said seat back for encapsulating said upper, lower, and back cushions.

19. A seat assembly as set forth in claim 18 wherein said trim cover is formed of polyethylene.

20. A seat assembly as set forth in claim 19 wherein said trim cover is formed of leather.

21. A seat assembly as set forth in claim 1 wherein seat bottom includes at least two rails adjacent and spaced from one another for retaining a portion of a seat track.

* * * * *